US010446958B2

(12) United States Patent
Sun et al.

(10) Patent No.: US 10,446,958 B2
(45) Date of Patent: Oct. 15, 2019

(54) CARD EDGE CONNECTOR EQUIPPED WITH DEFLECTABLE LATCH HAVING FOLDED LOCKING TAB WITH ROUND EDGE THEREOF

(71) Applicant: FOXCONN INTERCONNECT TECHNOLOGY LIMITED, Grand Cayman (KY)

(72) Inventors: Wei-Guo Sun, Kunshan (CN); Guang-Lei Xu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/103,048

(22) Filed: Aug. 14, 2018

(65) Prior Publication Data

US 2019/0052000 A1 Feb. 14, 2019

(30) Foreign Application Priority Data

Aug. 14, 2017 (CN) ..... 2017 1 0691469

(51) Int. Cl.

| | |
|---|---|
| ***H01R 12/83*** | (2011.01) |
| ***H01R 12/70*** | (2011.01) |
| ***H01R 12/52*** | (2011.01) |
| ***H01R 12/72*** | (2011.01) |
| ***H01R 13/506*** | (2006.01) |

(Continued)

(52) U.S. Cl.

CPC ..... *H01R 12/707* (2013.01); *H01R 12/52* (2013.01); *H01R 12/721* (2013.01); *H01R 12/83* (2013.01); *H01R 13/506* (2013.01); *H01R 4/02* (2013.01); *H01R 13/6273* (2013.01)

(58) Field of Classification Search

CPC ..... H01R 12/83
USPC ..... 439/326, 328
See application file for complete search history.

(56) References Cited

U.S. PATENT DOCUMENTS 5,002,498 A * 3/1991 Takahashi ..... H01R 12/721 439/326
5,413,496 A * 5/1995 Yu ..... H05K 7/1405 439/326

(Continued)

FOREIGN PATENT DOCUMENTS

CN 206195001 U 5/2017
TW 406885 U 9/2000

*Primary Examiner* — Phuong K Dinh
(74) *Attorney, Agent, or Firm* — Wei Te Chung; Ming Chieh Chang

(57) ABSTRACT

An electrical connector includes an insulative housing and a plurality of contacts are retained in the housing. A pair of metal latches are assembled on the housing. The latch includes a deflectable arm with a restriction tab for engagement within the corresponding notch of the memory module so as to restrict movement of the memory module in a front-to-back direction, and with a pressing tab beside the restriction tab for downwardly pressing the memory module so as to restrict movement of the memory module in a vertical direction. The pressing tab includes a downward oblique guiding section, and a folded section intimately under the guiding section with a curved linking region between the oblique guiding section and the folded section for downwardly pressing the surface of the memory module without scraping.

3 Claims, 11 Drawing Sheets

(51) Int. Cl.
*H01R 4/02* (2006.01)
*H01R 13/627* (2006.01)

(56) References Cited

U.S. PATENT DOCUMENTS 5,514,002 A * 5/1996 Cheng ..... H01R 12/721
439/326
5,695,354 A * 12/1997 Noda ..... H01R 12/716
439/326
5,791,925 A * 8/1998 Yu ..... H01R 12/83
439/326
6,030,245 A * 2/2000 Choy ..... H01R 12/7005
439/326
6,056,583 A * 5/2000 Lee ..... H01R 12/7005
439/157
7,677,907 B2 * 3/2010 Guan ..... H01R 12/7029
439/157

* cited by examiner

CARD EDGE CONNECTOR EQUIPPED WITH DEFLECTABLE LATCH HAVING FOLDED LOCKING TAB WITH ROUND EDGE THEREOF

BACKGROUND OF THE INVENTION

1. Field of the Invention

The invention relates to the electrical connector, particularly to the electrical connector equipped with the deflectable latch having the corresponding folded locking tab with a round/curved edge thereof.

2. Description of Related Art

The China Utility Patent No. CN206195001U discloses one card edge connector including an elongated housing with a plurality of contacts retained therein. The housing includes an elongated base with a pair of retaining arms at two opposite ends. The main body includes a pair of side walls with a receiving slot therebetween to receive the memory module. A pair of metal latches are assembled on the retaining arms, respectively. The latch includes a main body with a pressing tab and a restriction tab extending therefrom The pressing tab forms a sharp edge confronting the surface of the memory module, thus resulting in scraping during operation disadvantageously.

It is desired to have the electrical connector equipped with the metal latch which does not scrap the surface of the memory module.

SUMMARY OF THE INVENTION

An electrical connector includes an insulative housing having an elongated base having opposite side walls with a receiving slot therebetween for receiving therein a memory module which is installed into the housing in a rotational operation, and with a pair of retention arms at two opposite ends. A plurality of contacts are retained in the side walls. A pair of metal latches are assembled on the corresponding retention arms, respectively. The latch includes a deflectable arm with a restriction tab for engagement within the corresponding notch of the memory module so as to restrict movement of the memory module in a front-to-back direction, and with a pressing tab beside the restriction tab for downwardly pressing the memory module so as to restrict movement of the memory module in a vertical direction. The pressing tab includes a downward oblique guiding section, and a folded section intimately under the guiding section with a curved linking region between the oblique guiding section and the folded section for downwardly confronting and pressing the surface of the memory module without scraping.

Other objects, advantages and novel features of the invention will become more apparent from the following detailed description when taken in conjunction with the accompanying drawings.

DETAILED DESCRIPTION OF THE PREFERRED EMBODIMENT

Figure 1:
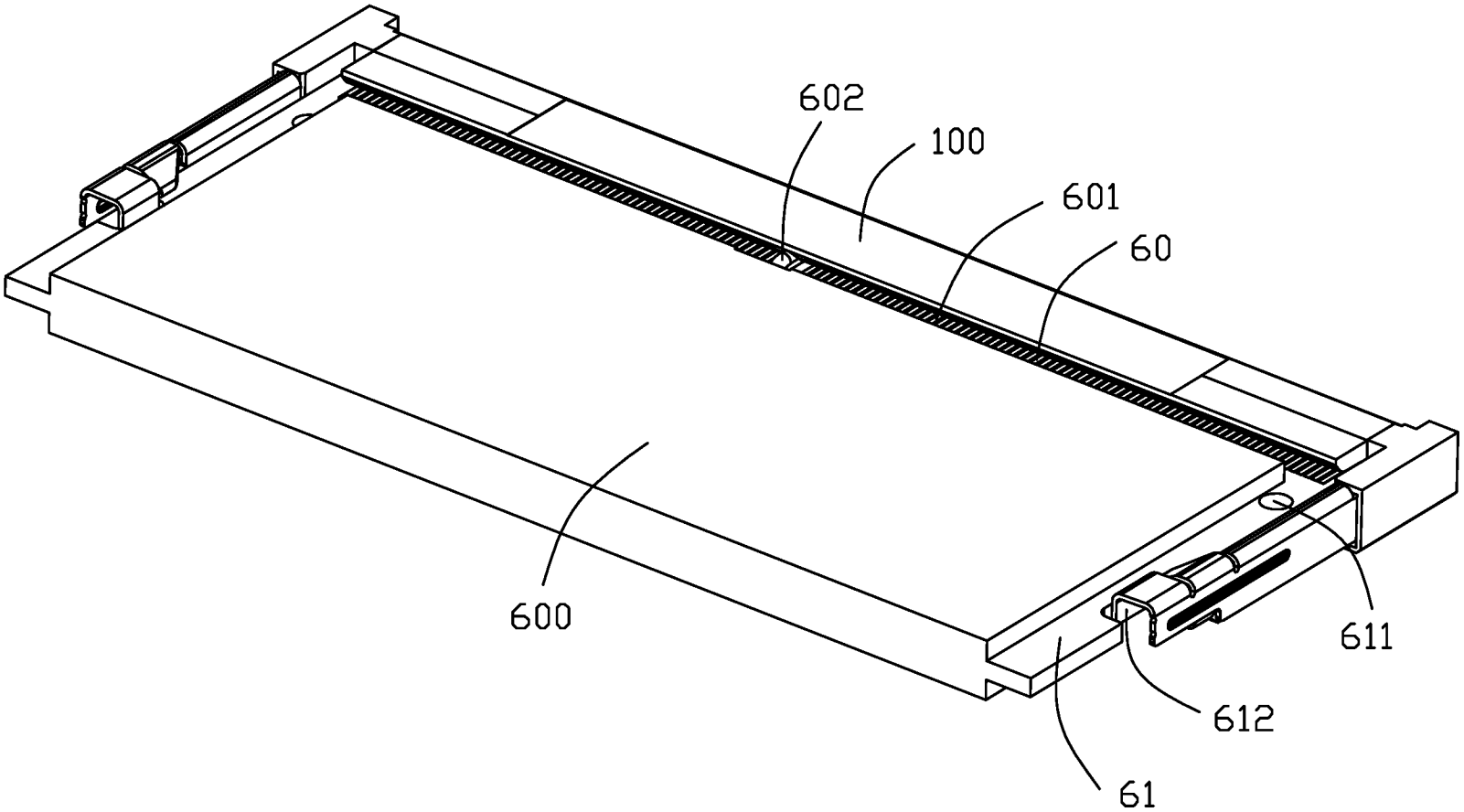
FIG. 1 is a perspective view of an electrical connector with a memory module therein according to the invention.
Figure 2:
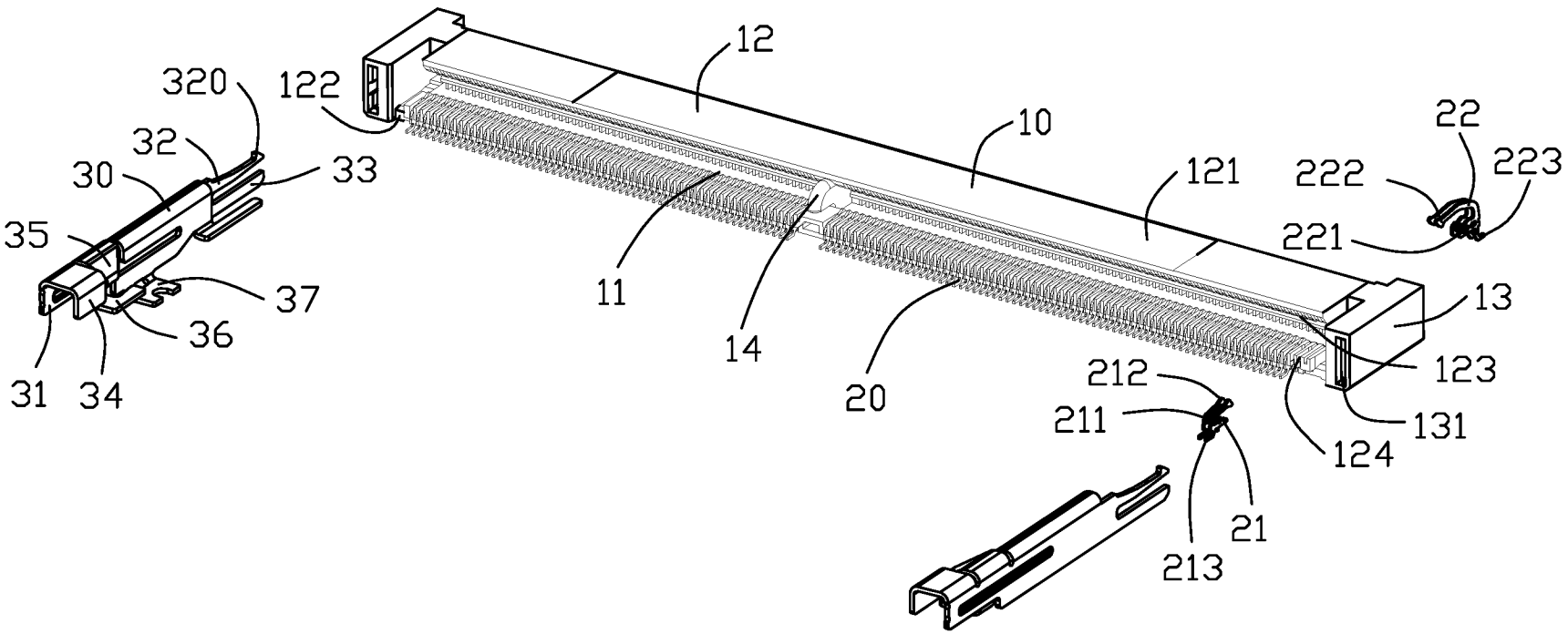
FIG. 2 is an exploded perspective view of the electrical connector of FIG. 1.
Figure 3:
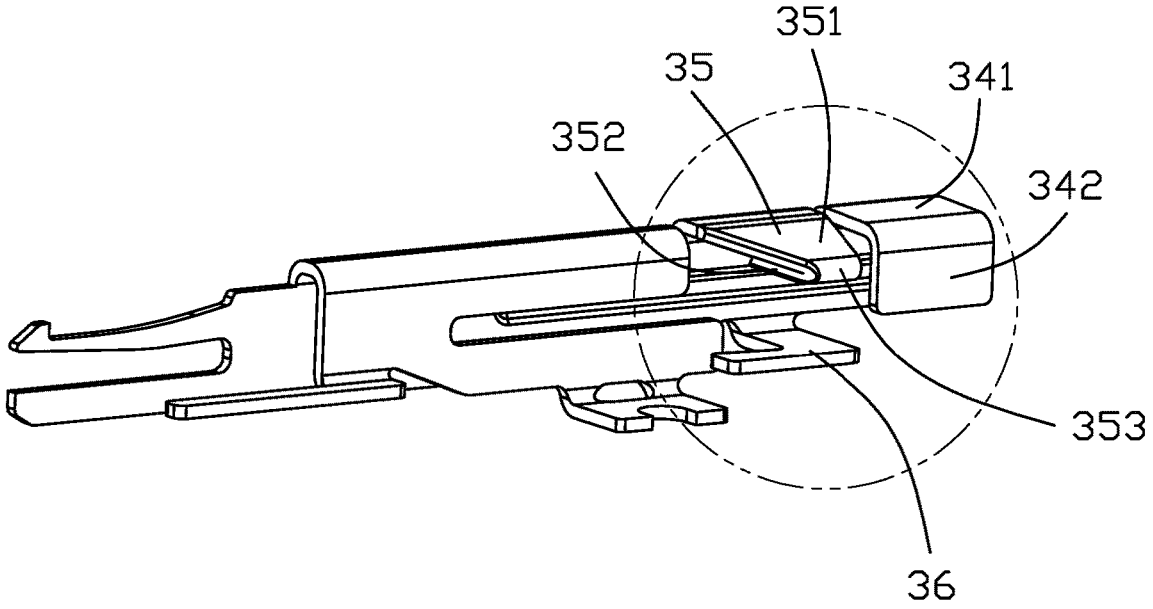
FIG. 3 is a perspective view of the metal latch of the electrical connector.
Figure 4:
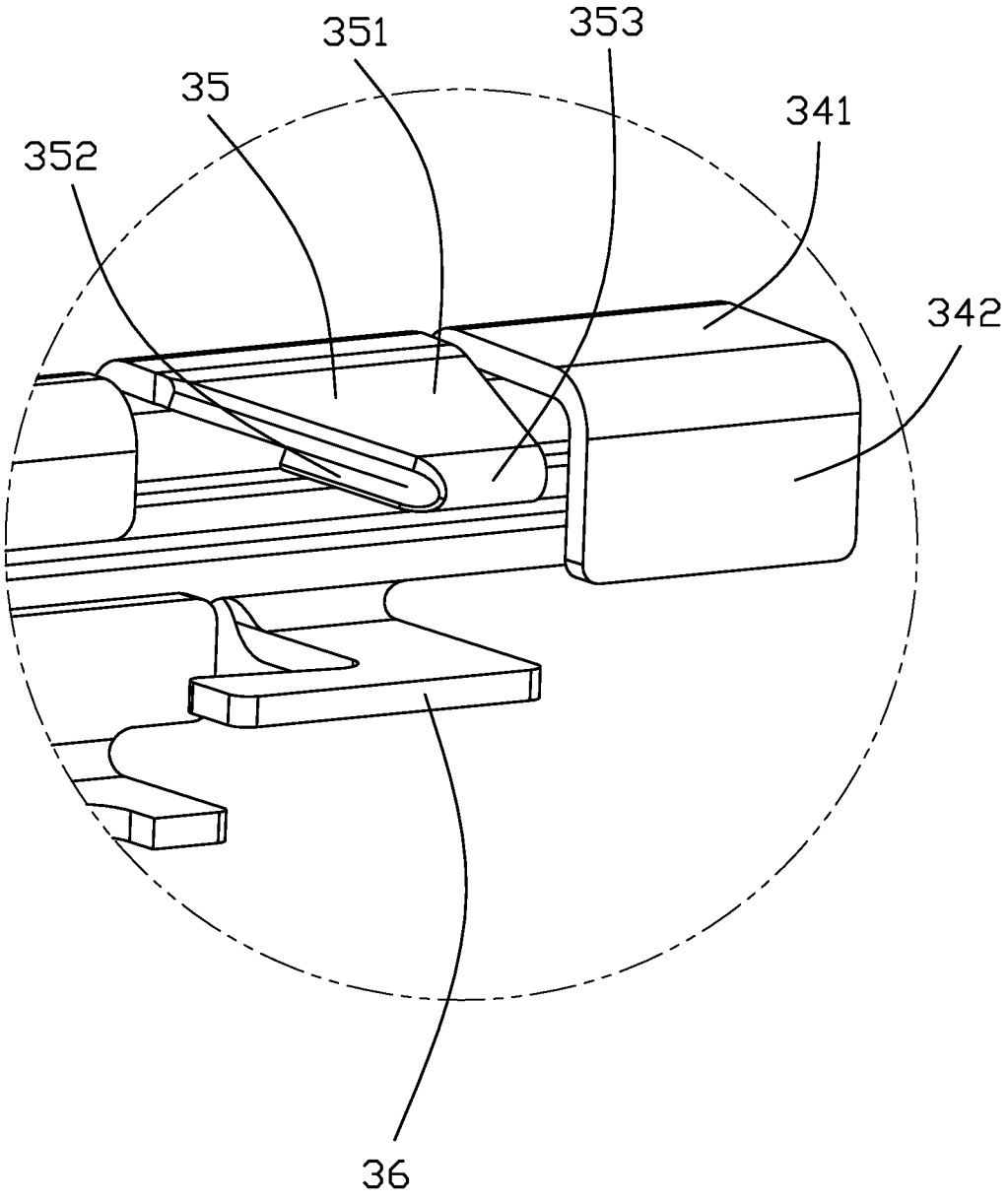
FIG. 4 is an enlarged perspective view of the latch of the electrical connector of FIG. 3.
Figure 5:
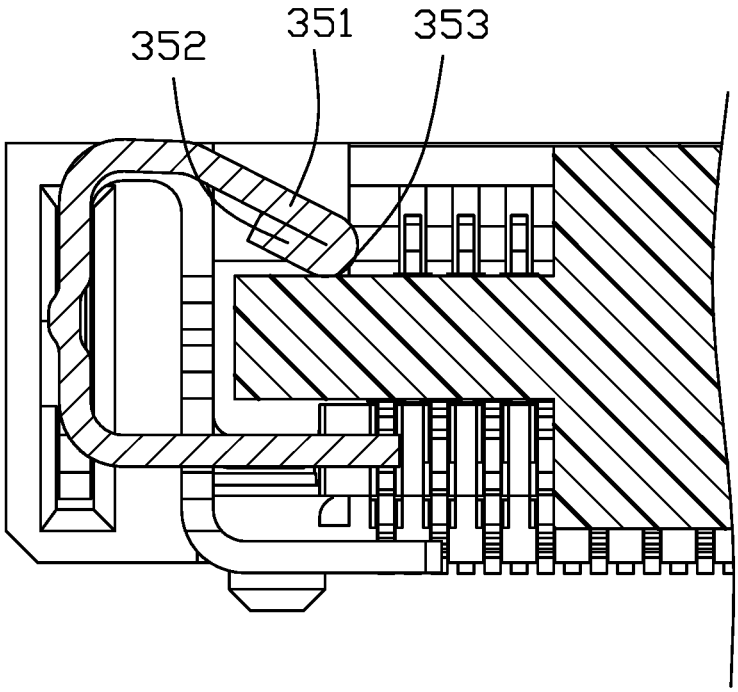
FIG. 5 is a cross-sectional view of a portion of the electrical connector with the memory module therein.
Figure 6:
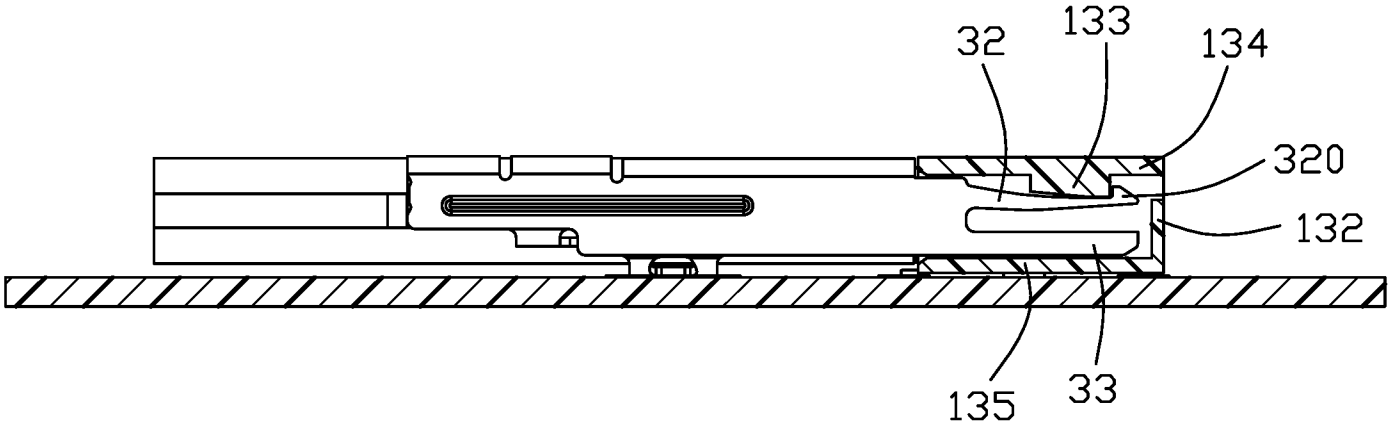
FIG. 6 is a cross-sectional view of the electrical connector of FIG. 1.

Referring to FIGS. 1-6, an electrical connector 100 is used to receive a memory module 600. The memory module 600 includes a mating region 60 and a pair of side regions 62. The mating region 60 has a plurality of conductive pads 601 thereon and a keyway 602 therein. Each side region 61 includes a hole 611 and a notch 612.

The connector 100 includes an elongated housing 10 with a pair of sidewalls 12 and a receiving slot 11 therebetween for receiving the mating region 60. A plurality of contacts 20 are retained in the housing 10. A pair of metal latch 30 are assembled to two opposite ends of the housing 10. A key 14 is formed in the slot 11 to be coupled with the keyway 602.

The sidewalls 12 includes a first sidewall 121 and a second sidewall 122, and the contacts 2 include a plurality of first contacts 21 retained in the first sidewall 121 and a plurality of second contacts 22 retained in the second sidewall 122. The first sidewall 121 forms a plurality of first passageways 123 to receive the first contacts 21, and the second sidewall 122 forms a plurality of second passageways 124 to receive the second contacts 22. The first contact 21 includes a first retaining section 211, a first contacting section 212 extending from the first retaining section into the slot 11, and a first soldering section 213 extending from the first retaining section 211 out of the first sidewall 121. Similarly, the second contact 22 has the second retaining section 221, the second contacting section 222 and the second soldering section 223.

The housing 1 further includes two end walls 13 in the longitudinal direction, to which the pair of metal latches 30 are assembled. The end wall 13 forms a retaining slot 131 with a rear plate 132 and a bottom plate 135 thereabouts. The latch 30 includes a main body 31, a retaining arm 32 and an abutment arm 33 both of which are disposed in the retaining slot 131 wherein the retaining arm 32 engages the upper plate 134 above the retaining slot 131. The retaining arm 32 forms a hook 320 at a free end. The latch 30 further includes the restriction tab 34 for engagement with in the notch 612, and a pressing tab 35 for abutting against the upward surface of the memory module 600 when the memory module 600 is retained in the connector 100. The restriction tab 34 includes a horizontal section 341 and a vertical section 342 so as to cooperate with the main body 31 to commonly form an upside-down U-shaped configuration. The pressing tab 35 includes an oblique guiding section 351 and a reversely extending folded section 352 under the guiding section 351 with therebetween a curved/round linking region 353 which directly confronts and presses the upward surface of the memory module 600 for restricting upward movement of the memory module 600 relative to the connector 100. A protection tab 36 extends horizontally from a lower edge of the main body 31 which not only upwardly supports/confronts the memory module 600 for preventing excessive downward movement of the memory module 600 but also sidewardly restrain excessive outward/lateral movement of the main body 31 during unlatching the memory module 600 from the connector 100. Notably, the latch 30 includes a solder pad 37 extending from the main body 31 and adapted to be soldered upon the printed circuit board wherein the protection tab 36 forms forward extension adapted to abut against the vertical part above the solder pad 37 when the front section of the main body 31 is excessively outwardly manually deflected during unlatching the memory module 600 from the connector 100.

Figure 7:
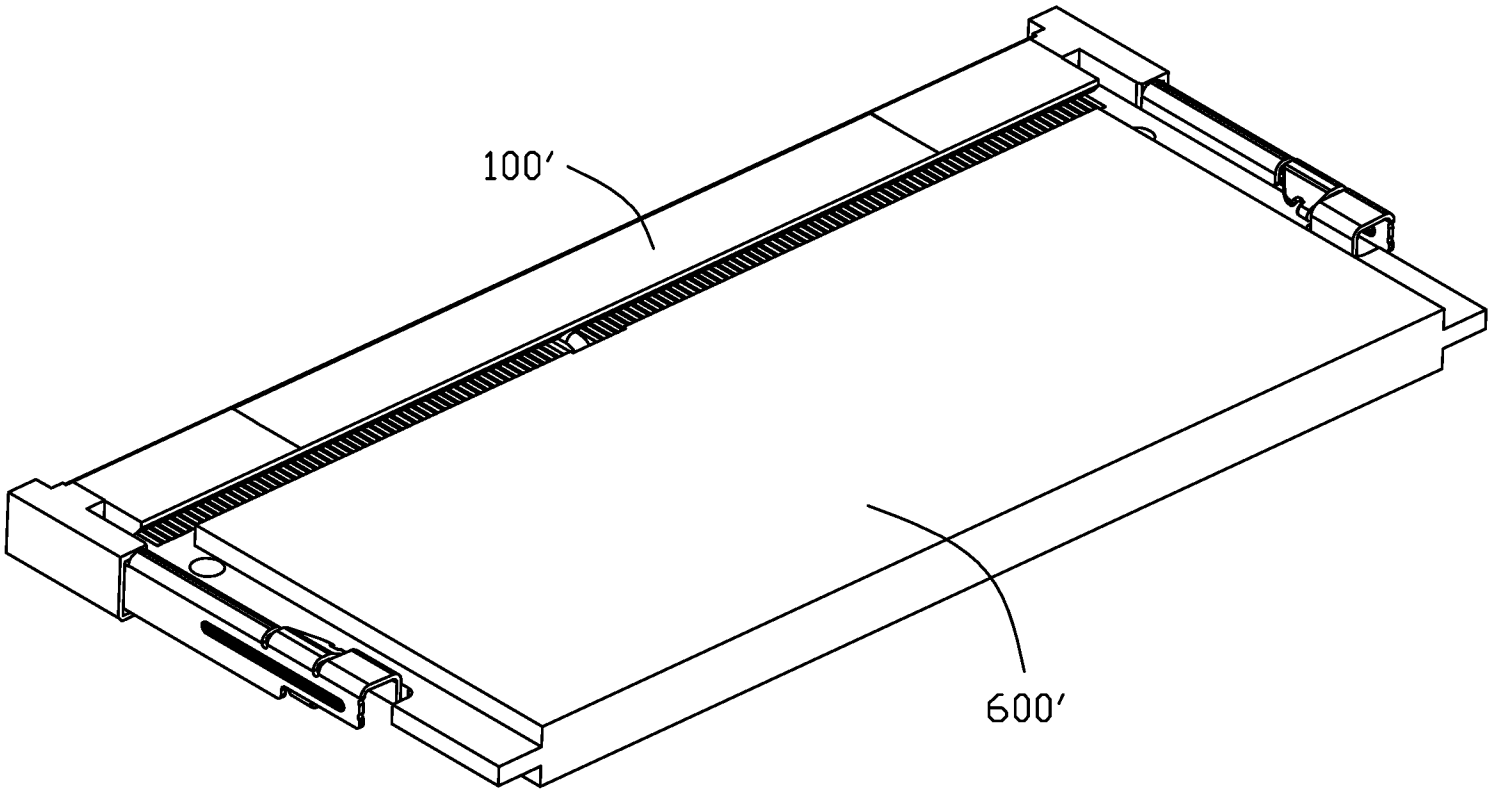
FIG. 7 is a perspective view of the electrical connector according to another embodiment of the invention.
Figure 8:
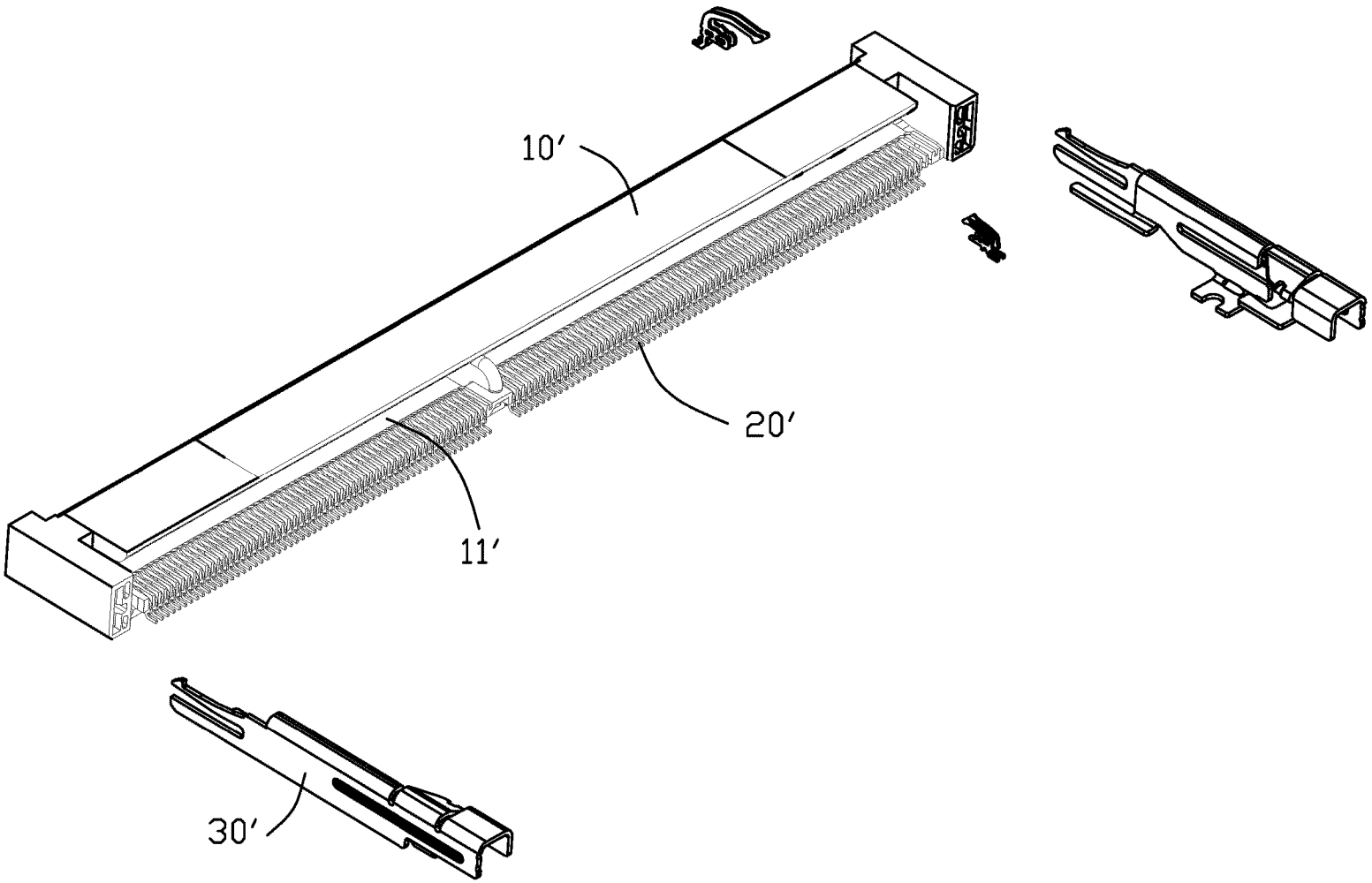
FIG. 8 is an exploded perspective view of electrical connector of FIG. 7.
Figure 9:
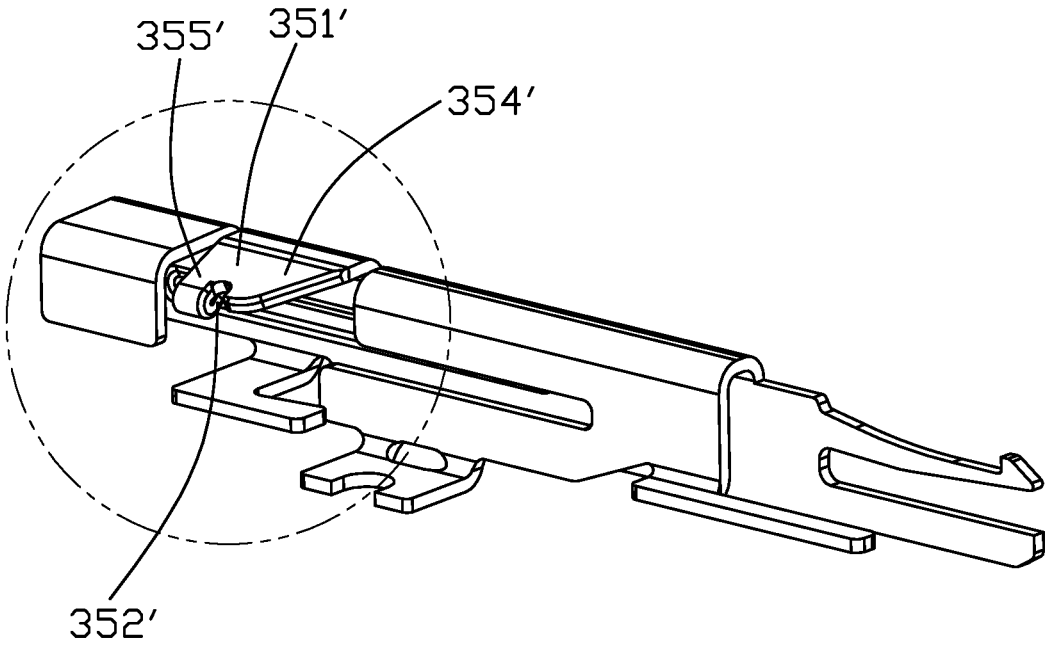
FIG. 9 is a perspective view of the metal latch of the electrical connector of FIG. 7.
Figure 10:
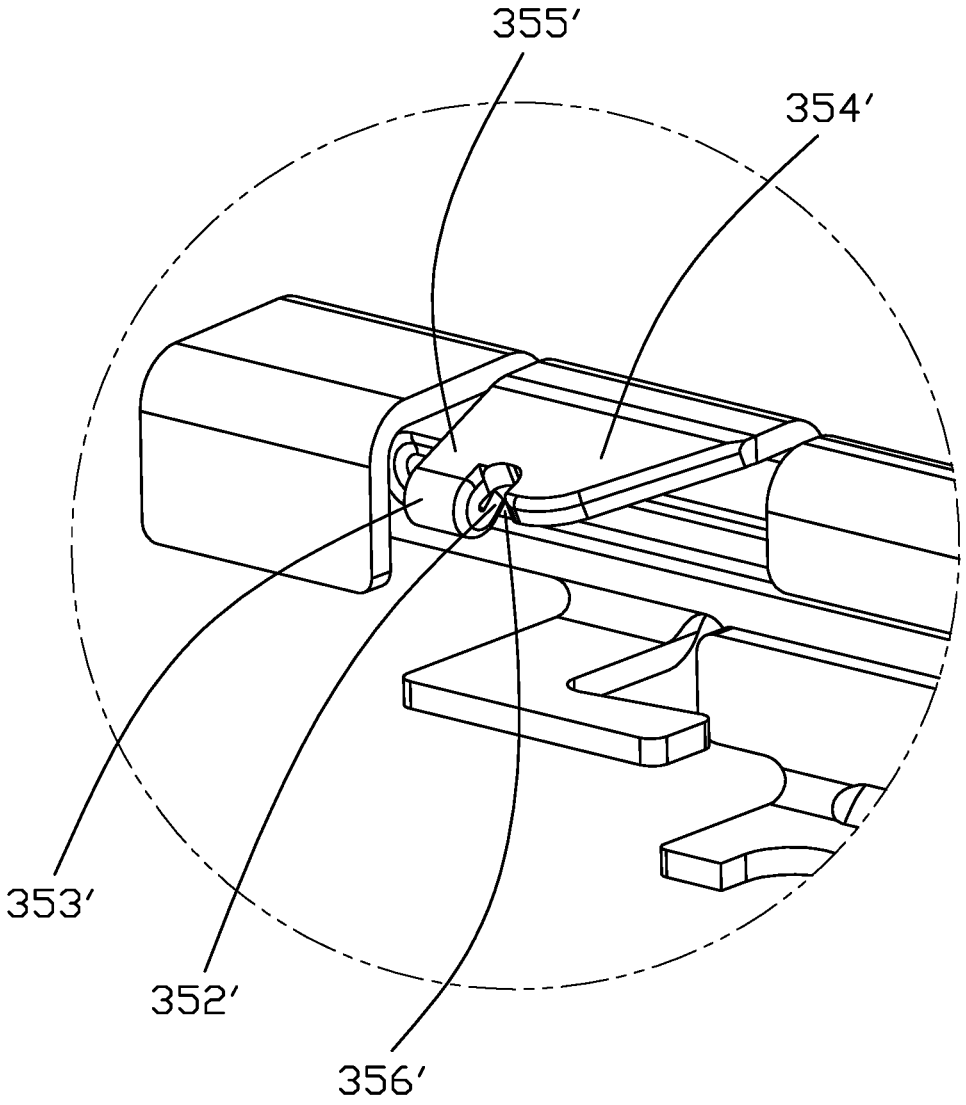
FIG. 10 is an enlarged perspective view of the metal latch of the electrical connector of FIG. 9.
Figure 11:
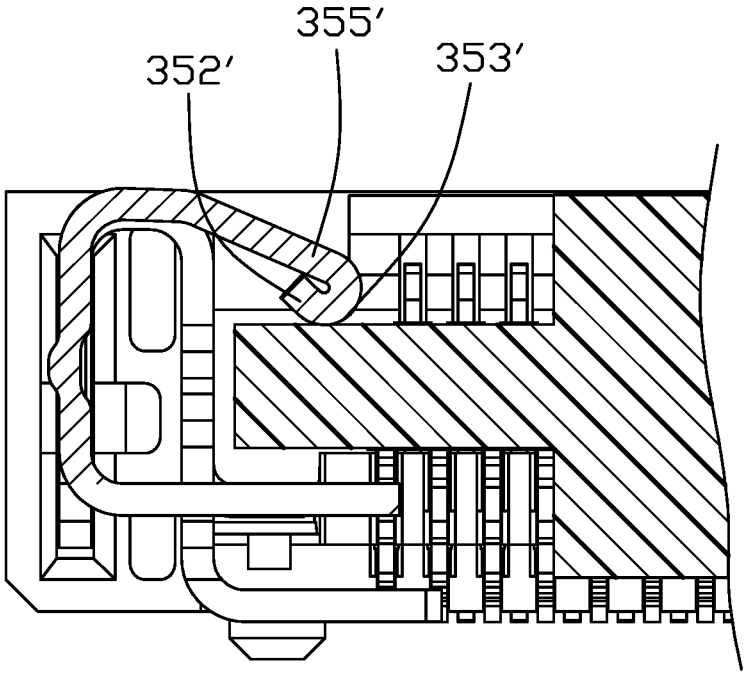
FIG. 11 is a cross-sectional view of a portion of the electrical connector of FIG. 7.

FIGS. 7-11 show the connector 100', according to the second embodiment, having the housing 10', the contacts 20 and metal latches 30 similar to the first embodiment. The guiding section 351' includes a front part 354' and a rear part 355'. The folded section 352' extends from the rear part 355' so as to form a curved/round linking region 353'. A gap is formed between the rear part 355' and the folded section 352'. A notch 356' is formed between the front part 354' and the rear part 355' in the front-to-back direction. In this embodiment, the front part 354' only provides the guiding function without linking to any folded section, so no barbs due to folding may affect the memory module 600 around the front part 354'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector for receiving a memory module defining opposite upper and lower surfaces, and a pair of notches in two opposite lateral side regions, comprising:

an insulative housing includes an elongated base forming a receiving slot for receiving a memory module which is assembled in a rotational manner;

a plurality of contacts retained in the housing with contacting sections extending into the receiving slot; and a pair of metal latches assembled to two opposite ends of the housing, each of the latches including a deflectable main body with, around an end section thereof, a restriction tab for engagement within the corresponding notch and pressing tab for downward abutting against the upper surface when the memory module is retained in the receiving slot; wherein the pressing tab includes a downwardly extending oblique guiding section and a folded section intimately under the guiding section with therebetween a round linking region adapted to downwardly pressing the upper surface of the memory module without scraping, wherein the guiding section is divided into a front part and a rear part with a notch therebetween, and the folded section is linked to the rear part only, wherein a tiny space is formed between the folded section and the rear part, wherein said latch further includes a protection tab under the pressing tab to laterally abut against a stationary part of the latch for avoiding excessive outward deflection of the main body, wherein said stationary part is linked to a solder pad which is adapted to be soldered upon a printed circuit board on which the connector is seated.

2. An electrical connector assembly comprising:

a memory module defining opposite upper and lower surfaces in the vertical direction, and forming a mating region and a pair of side regions each having a notch therein;

an electrical connector including:

an insulative housing defining a receiving slot receiving said memory module therein;

a plurality of contacts retained in the housing and mechanically and electrically connected to the mating region; and a pair of metal latches secured to two opposite ends of the housing and locking the memory module in a horizontal position with regard to the housing, each of said latches including a deflectable main body with, around a free end, a restriction tab engaged within the corresponding notch, and a pressing tab downwardly pressing the upper surface of the memory module; wherein the pressing tab includes a downwardly extending oblique guiding section, and a folded section intimately under the guiding section with therebetween a curved/round linking region downwardly pressing the upper surface of the memory module without scraping during latching or unlatching the memory module with regard to the electrical connector, wherein the guiding section is divided into a front part and a rear part with a notch therebetween in a front-to-back direction, wherein the folded section is linked to the rear part only, wherein a small space is formed between the folded section and the rear part, wherein said latch further includes a protection tab under the pressing tab to laterally abut against a stationary part of the latch for avoiding excessive outward deflection of the main body, wherein said stationary part is linked to a solder pad which is adapted to be soldered upon a printed circuit board on which the connector is seated.

3. A metal latch for use a memory module retained within a card edge connector having an insulative housing and a plurality of contacts therein, comprising:

a deflectable main body;

a retaining arm formed at a rear end of the main body for engagement within the housing;

a solder pad below the main body for mounting to a printed circuit board on which the housing is seated;

a restriction tab at a front end of the main body;

a pressing tab formed on the main body and behind the restriction tab in a front-to-back direction; wherein said pressing tab includes a downwardly extending oblique guiding section and a folded section intimately under the oblique guiding section with therebetween a linking region having a curved/round contour for pressing downwardly an upper surface of the memory module without scraping during latching or unlatching the memory module with regard to the housing, wherein the guiding section is divided into a front part and a rear part with a notch therebetween in a front-to-back direction, wherein the folded section is linked to the rear part only, wherein a small space is formed between the folded section and the rear part, wherein said latch further includes a protection tab under the pressing tab to laterally abut against a stationary part of the latch for avoiding excessive outward deflection of the main body, wherein said stationary part is linked to a solder pad which is adapted to be soldered upon a printed circuit board on which the connector is seated.

* * * * *